US010982560B2

(12) United States Patent
Isemene et al.

(10) Patent No.: US 10,982,560 B2
(45) Date of Patent: Apr. 20, 2021

(54) BLADE AND METHOD FOR RELOADING AN ABRADABLE COATING

(71) Applicant: SAFRAN AIRCRAFT ENGINES, Paris (FR)

(72) Inventors: Michael Isemene, Moissy-Cramayel (FR); Alexandre Branco, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 19 days.

(21) Appl. No.: 16/092,733

(22) PCT Filed: Apr. 10, 2017

(86) PCT No.: PCT/FR2017/050862
§ 371 (c)(1),
(2) Date: Oct. 10, 2018

(87) PCT Pub. No.: WO2017/178747
PCT Pub. Date: Oct. 19, 2017

(65) Prior Publication Data

US 2019/0120074 A1 Apr. 25, 2019

(30) Foreign Application Priority Data

Apr. 12, 2016 (FR) ..... 1653220

(51) Int. Cl.
*F01D 11/12* (2006.01)
*F01D 5/14* (2006.01)
(Continued)

(52) U.S. Cl.
CPC ..... *F01D 11/122* (2013.01); *F01D 5/147* (2013.01); *F01D 5/20* (2013.01); *F01D 5/30* (2013.01);
(Continued)

(58) Field of Classification Search
None
See application file for complete search history.

(56) References Cited

U.S. PATENT DOCUMENTS 7,252,478 B2 * 8/2007 Aynsley ..... F03B 17/063 416/204 R
7,410,342 B2 * 8/2008 Matheny ..... F01D 5/147 29/419.1
(Continued)

FOREIGN PATENT DOCUMENTS

DE 1 628 262 A1 1/1972
EP 2 813 672 A1 12/2014
EP 2 899 371 A1 7/2015

OTHER PUBLICATIONS

International Search Report dated Jul. 13, 2017, issued in corresponding International Application No. PCT/FR2017/050862, filed Apr. 10, 2017, 6 pages.

*Primary Examiner* — David Hamaoui
*Assistant Examiner* — Jason Fountain
(74) *Attorney, Agent, or Firm* — Christensen O'Connor Johnson Kindness PLLC

(57) ABSTRACT

The invention relates to a blade (16), in particular a fan blade, for resurfacing an abradable coating (26) on an internal surface of a turbine engine case (18) intended to surround the blade. The comprises a root (20) and an airfoil (24) having a tip opposite the root, said root comprising a housing (32) for the storage or passage of a polymerisable refill resin. The airfoil comprises longitudinal channels (34), the first ends of said channels being connected to the housing and the opposite ends opening at the aforementioned tip.

10 Claims, 2 Drawing Sheets

(51) Int. Cl.
*F01D 5/20* (2006.01)
*F01D 5/30* (2006.01)

(52) U.S. Cl.
CPC ..... *F05D 2220/36* (2013.01); *F05D 2230/80* (2013.01); *F05D 2230/90* (2013.01); *F05D 2240/55* (2013.01); *F05D 2300/44* (2013.01)

(56) References Cited

U.S. PATENT DOCUMENTS

| | | | | |
|---|---|---|---|---|
| 8,540,487 | B2 * | 9/2013 | Bottome | F01D 11/22 416/174 |
| 9,133,726 | B2 * | 9/2015 | McCaffrey | F01D 11/08 |
| 2002/0090302 | A1 | 7/2002 | Norris et al. | |
| 2006/0018751 | A1 * | 1/2006 | Aynsley | F04D 29/34 415/220 |
| 2007/0243070 | A1 * | 10/2007 | Matheny | F01D 5/284 416/230 |
| 2009/0074563 | A1 * | 3/2009 | McCaffrey | F01D 9/065 415/115 |
| 2011/0002776 | A1 * | 1/2011 | Bottome | F01D 5/20 415/173.3 |
| 2015/0192029 | A1 * | 7/2015 | Roberts, III | F01D 5/147 415/173.1 |

* cited by examiner

BLADE AND METHOD FOR RELOADING AN ABRADABLE COATING

TECHNICAL FIELD

The present invention concerns a blade and a method for reloading an abradable layer on an internal surface of a turbine engine casing intended to surround the blade.

STATE OF THE ART

The state of the art comprises in particular documents US-A 1-2002/090302, EP-A1-2 813 672, DE-A1-16 28 262, EP-A1-2 899 371 and US-A1-2007/243070.

A turbine engine comprises rotor blades that rotate inside casings. It is known to provide on the internal surface of such a casing a layer of abradable material with which the ends of the blades are intended to cooperate by friction in order to limit the non-functional leakage air flow between these ends and the casing, thereby optimising the performance of the turbine engine.

It is especially the case with fan blades of a turbine engine which are surrounded by a retaining casing on the internal surface of which is deposited a layer of abradable material or abradable layer.

The abradable layer is intended to be worn by friction as mentioned above. When it is too worn or when it is damaged for example by impacts of foreign bodies, it must be repaired in order to retain the expected performance of the turbine engine.

Two solutions are then possible: the removal or the replacement of the abradable layer or its reloading for the purpose for example of filling in holes or filling in excessively worn zones. These two operations are long and expensive and systematically require disassembling the engine from the aircraft to which it is fixed.

This invention proposes a simple, effective and economical solution to this problem.

DISCLOSURE OF THE INVENTION

The invention proposes a blade, in particular a fan blade, for reloading an abradable layer on an internal surface of a turbine engine casing intended to surround the blade, the blade comprising a root and an airfoil having a tip opposite said root, the root comprising a housing for the storage or passage of a polymerisable refill resin, and the airfoil comprising longitudinal ducts, whose first ends are connected to said housing and the opposite ends open at said tip.

The invention is particularly advantageous because it uses a blade for reloading an abradable layer. This blade is indeed configured to be able to deposit or project reloading resin during the rotation of the rotor that supports this blade. Under the effect of the centrifugal forces, the resin in intended to be displaced from the housing to the ducts and then to the tip of the blade, in order to then be deposited or projected onto the casing. The reloading of the layer can be carried out under the wing without disassembling the turbine engine and therefore involves a limited time of aircraft immobilisation.

The blade according to the invention can comprise one or several of the following characteristics, taken separately from one another or in combination with one another:

- the blade comprises a series of longitudinal ducts substantially aligned along a chord of the blade,
- the blade further comprises a scraping member, even a spreading member, fixed on said tip,

- said member is removably fixed on said end, for example by interlocking,
- said member has an elongated shape and extends along a chord of the blade; the member and the ducts can extend according to the same chord of the blade, in such a way that they can communicate with each other for example,
- said member comprises a cavity in fluidic communication with openings of said ducts for its supply of resin, and at least one duct for dispensing resin extending from said cavity to an end of the member opposite said root.

The invention also concerns a method for reloading an abradable layer on an internal surface of a fan casing of a turbine engine, comprising the following steps:

- disassembling at least one blade of a rotor, in particular a fan blade, of said turbine engine and replacing it with a blade such as described above,
- rotating said rotor in such a way that resin contained in said housing flows via the centrifuge effect into said ducts and is deposited or projected onto said surface.

Advantageously, the method comprises a step consisting in spreading and scraping the resin deposited, by means of said member.

Preferably, several, for example four, blades of the rotor are replaced with blades such as described above, which are evenly distributed about the axis of rotation of the rotor.

DESCRIPTION OF THE FIGURES

The invention shall be better understood and other details, characteristics and advantages of the invention shall appear more clearly upon reading the following description given as a non-limiting example and in reference to the accompanying drawings wherein.

DETAILED DESCRIPTION

Figure 1:
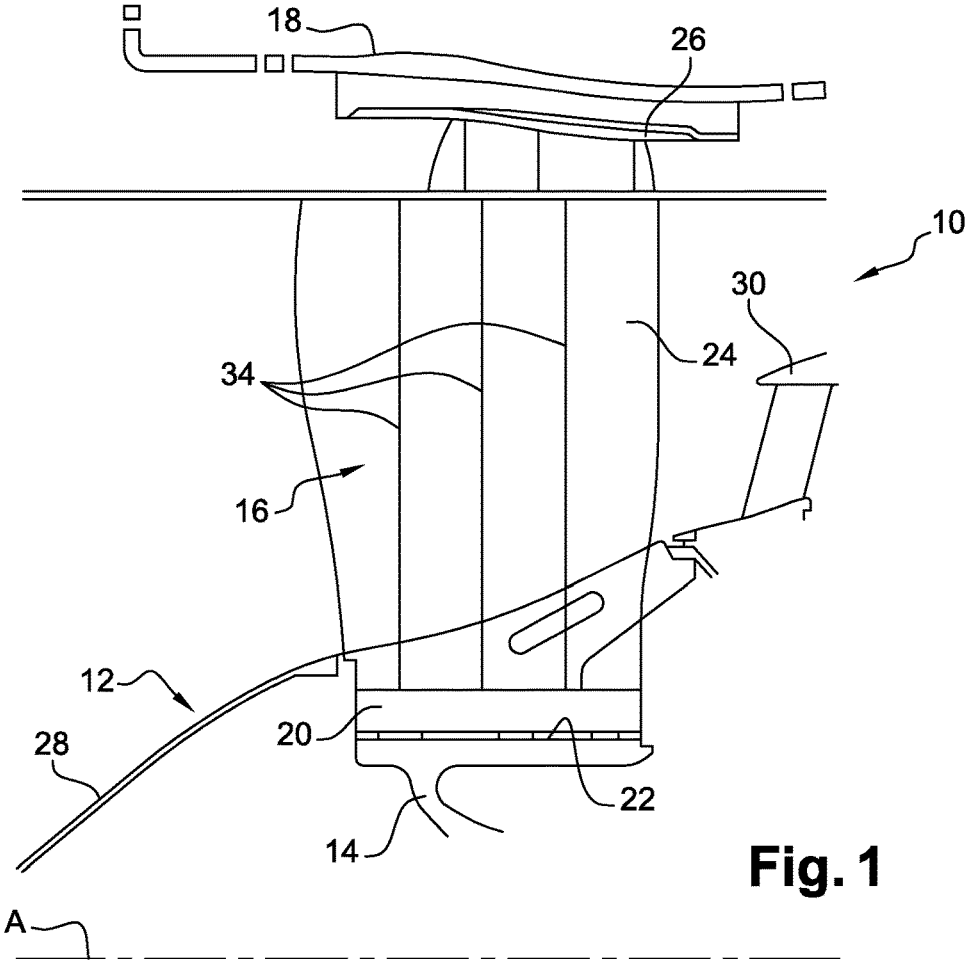
FIG. 1 is a diagrammatical half-view as an axial cross-section of a turbine engine fan, FIG. 1 showing the external periphery of the fan on a smaller scale than its internal periphery.

FIG. 1 partially represents a fan 10 of a turbine engine, such as an aircraft turbojet engine.

Conventionally, a turbine engine comprises from upstream to downstream, i.e. in the direction of flow of the gas flows, a fan, one or several compressors, a combustion chamber, one or several turbines, and an exhaust nozzle of the combustion gases exiting from the turbine or turbines.

The fan 10 is therefore located at the upstream end of the turbine engine. It comprises a rotor 12 comprising a hub 14 carrying an annular row of blades 16, so-called of fan, the rotor 12 rotating inside a retaining casing 18.

The rotor 12 comprises at its external periphery an annular row of cells for mounting roots 20 of blades 16. Each cell 22 in general has a section in the shape of a dovetail and each blade root has a complementary shape of the cell in order to allow for a mounting of the blade by fitting of its root into the cell.

In a known manner, a shim can be inserted between the root of a blade and the bottom of the cell 22 for receiving this root, so as to immobilise it.

Each blade 16 comprises an airfoil 24 which extends from the root radially outwards with respect to the axis A of rotation of the rotor 12. The airfoil comprises a tip opposite the root, i.e. at its radially external end.

The retaining casing 18 here has a generally cylindrical shape and extends around the fan blades 16. It comprises an internal cylindrical surface whereon is provided an annular layer 26 of abradable material. This layer 26 surrounds the blades 16 and extends over the entire longitudinal dimension of the blades along the axis A.

The fan rotor 12 is located downstream from an inlet cone 28, that can be secured to the rotor 12, and upstream from an annular separator 30, whose function is to divide the annular inlet air flow path that passes through the fan blades into two coaxial annular flow paths, respectively internal for the generation of a primary flow or hot flow, and external for the generation of a secondary flow or cold flow.

The invention concerns a blade for the reloading of an abradable layer on the internal surface of a casing such as the casing 18 of FIG. 1.

Figure 2:
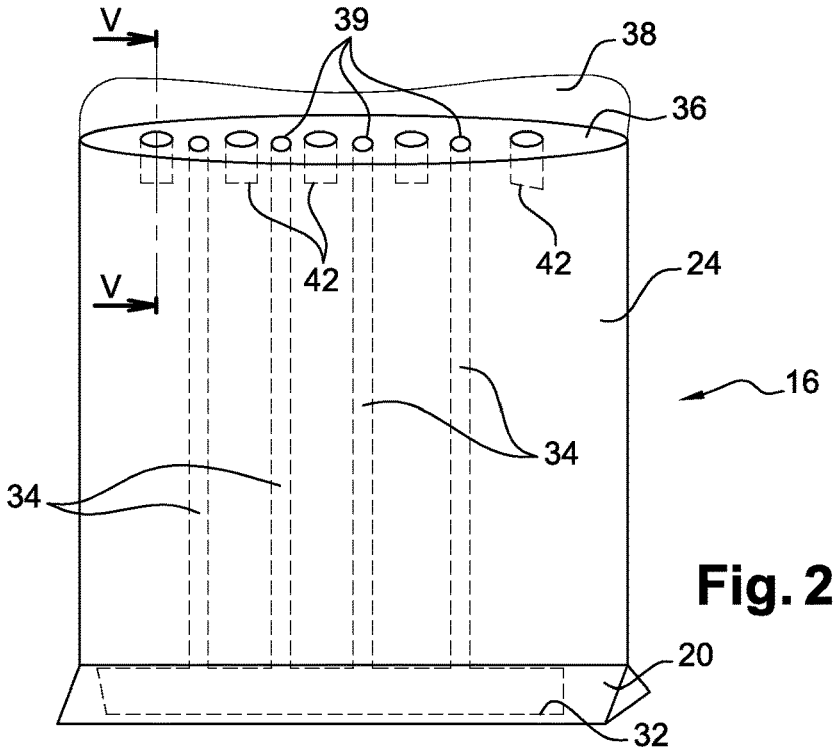
FIG. 2 is a highly diagrammatical perspective view of a blade according to the invention.

The root 20 of the blade 12, better seen in FIG. 2, comprises a housing 32 for the storage or passage of a polymerisable refill resin. In other words, this housing 32 can either be connected to a source of resin and ensure the distribution of the resin to the rest of the blade, or itself form the source of resin. In this latter case, the housing 32 can directly contain the resin or be conceived to receive a cartridge of resin.

The resin can be of the two-component type and as such include two components, such as a resin component and a hardening component, intended to be mixed and to harden via polymerisation, for example at ambient temperature. The epoxy-based resin marketed by the company 3M under the name Scotch-Weld™ is suitable for example for this application.

The airfoil 24 of the blade 16 comprises several ducts 34 for conveying resin to the tip of the blade. These ducts are longitudinal, i.e. they extend along the longitudinal axis of the airfoil, which is a substantially radial axis with respect to the axis A. The ducts 34 are preferably substantially straight in order to facilitate the aforementioned conveyance. They have for example a diameter of a few millimetres, this diameter being naturally dependent on the viscosity of the resin at its temperature of use.

The ducts 34 extend between the housing 32 and the tip of the airfoil 24. The radially internal ends of the ducts 34 open into the housing 32 and their radially external ends open onto a radially external end surface 36 of the airfoil, which is intended to be facing the abradable layer 26.

Figure 4:
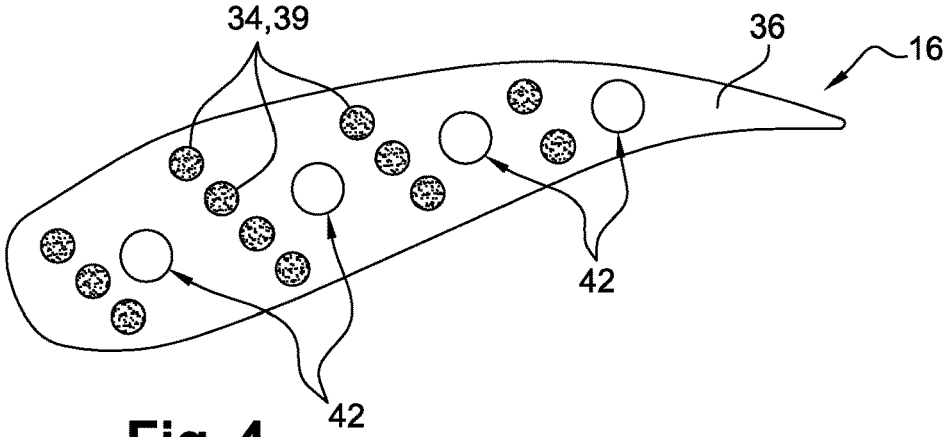
FIG. 4 is a highly diagrammatical view of an end of a blade according to the invention.

The FIGS. 2 and 4 show in more detail the end surface 36 as well as the openings 39 of the ducts 34 onto this surface 36. The number of internal ducts in the airfoil can be relatively high. They can be grouped together by group, as represented in FIG. 4. The ducts 34 can be distributed over the surface and be aligned along a chord of the blade.

The tip of the blade 16 is advantageously provided with a member 38 for spreading and scraping, which is applied and fixed onto the end surface 36.

Figure 5:
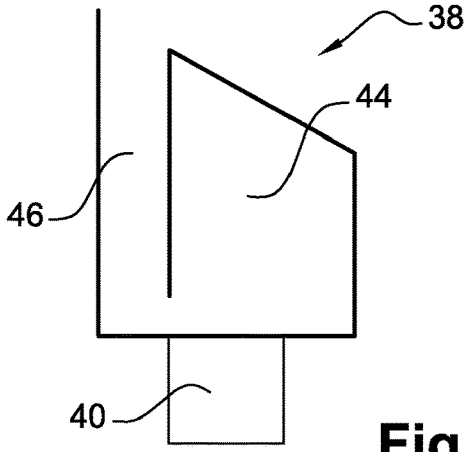
FIG. 5 is a cross-section view along the line V-V of FIG. 3.

The member 38 has an elongated shape and is intended to extend along the chord of the blade. It is advantageously removably fixed on the blade, for example by interlocking or elastic snap-fitting. In the example represented, the member 38 comprises lugs 40 or clips intended to cooperate with orifices 42 provided at the tip of the blade and opening onto the surface 36, these lugs being shown in FIG. 5. This figure shows an embodiment of the member 38 which comprises a cavity 44 intended to be in fluidic communication with the openings 39 of the ducts 34 for the supply thereof with resin. For this, the member 38 can comprise a radially internal bottom wall pierced with orifices intended to be aligned with the openings 39 of the ducts, when the member is mounted on the airfoil. The member 38 further comprises at least one duct 46 for dispensing resin extending from the cavity 44 to a radially external end of the member 38. This end is more preferably configured to spread the resin and scrape the excess resin. It is shaped to reproduce the theoretical profile of the inlet air flow path of the fan.

The invention also concerns a method for reloading an abradable layer 26 comprising the steps consisting in:

- disassembling at least one blade of the rotor and replacing it with a blade 16 such as described hereinabove,
- rotating the rotor in such a way that the resin contained in the housing 32 flows by centrifuge effect into the ducts 34 and is deposited or projected onto the abradable layer 26.

In the case where the blade is provided with a member 38, the method comprises a step consisting in spreading and in scraping the resin deposited, by means of this member.

Figure 3:
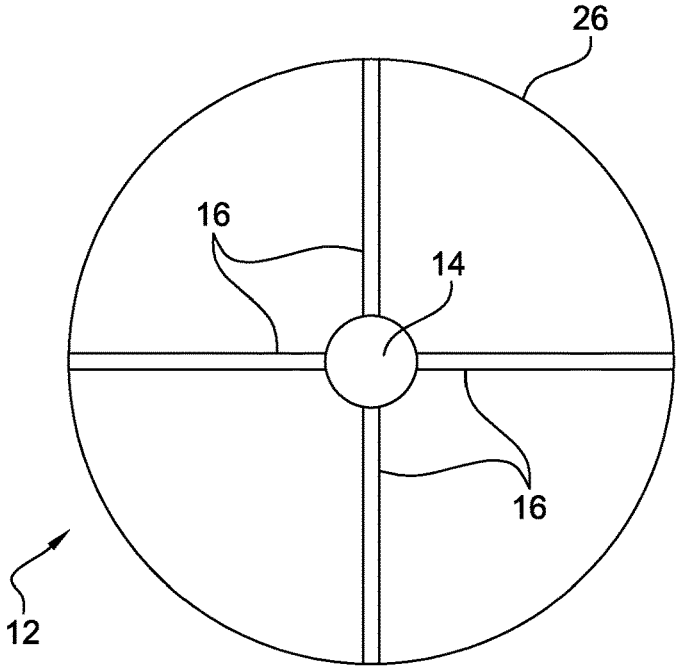
FIG. 3 is a highly diagrammatical front view of a fan rotor provided with four blades according to the invention.

Advantageously, and as shown in FIG. 3, several, and for example four, blades of the rotor are replaced with blades 16. These blades 16 are more preferably evenly distributed about the axis of rotation of the rotor, the other original blades of the rotor not being shown in the figure for more clarity.

In a particular embodiment of the invention, a pump is used to force the resin to flow from the housing of each airfoil along the internal ducts thereof. In practice, the pump can be adjusted to a pressure of 150 bars and the fan can be rotationally driven for example manually or by self-rotation, when the pump is turned on.

In another embodiment of the invention, the resin is forced to flow in the ducts solely by the centrifugal force applied due to the rotation of the fan, for example at a speed of about 500 rpm.

The invention claimed is:

1. A device for reloading an abradable layer on an internal surface of a turbine engine casing configured to surround the a blade, the device comprising:

- the fan blade comprising a root comprising a housing configured for storage or passage of a polymerisable refill resin and an airfoil having a tip opposite said root, the airfoil comprising longitudinal ducts configured for conveying the resin and having first ends connected to said housing and second ends open on said tip opposite said first ends,
- a polymerisable refill resin, stored in the housing of the fan blade.

2. The device of claim 1, wherein the longitudinal ducts are aligned along a chord of the fan blade.

3. The device of claim 1, further comprising a scraping member fixed on said tip.

4. The device of claim 3, wherein said scraping member is removably fixed on said tip.

5. The device of claim 4, wherein said scraping member is removably fixed on said tip by interlocking.

6. The device of claim 3, wherein said scraping member has an elongated shape and extends along a chord of the fan blade.

7. The device of claim 3, wherein said scraping member comprises a cavity in fluidic communication with openings of said ducts for receiving resin therefrom, and at least one duct for dispensing resin extending from said cavity to an end of the scraping member opposite said tip.

8. A method for reloading an abradable layer on an internal surface of a casing of a turbine engine, the method comprising:

disassembling at least one blade of a rotor of said turbine engine and replacing said at least one blade with a device according to claim 1; and rotating said rotor such that resin contained in said housing flows via centrifugal effect into said ducts and is deposited onto said internal surface.

9. The method of claim 8, wherein the fan blade of the device has a scraping member fixed on said tip and the method further comprises:

spreading the deposited resin with said scraping member; and scraping the spread resin with said scraping member.

10. The method of claim 8, wherein two or more blades of the rotor are replaced with said devices and are evenly distributed about an axis of rotation of the rotor.

* * * * *